US007772498B2

(12) United States Patent
Kobayashi et al.

(10) Patent No.: US 7,772,498 B2
(45) Date of Patent: Aug. 10, 2010

(54) WIRE HOLDER

(75) Inventors: Tomohiko Kobayashi, Yokkaichi (JP); Takao Hata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 344 days.

(21) Appl. No.: 11/906,890

(22) Filed: Oct. 4, 2007

(65) Prior Publication Data

US 2008/0083557 A1 Apr. 10, 2008

(30) Foreign Application Priority Data

Oct. 6, 2006 (JP) ..... 2006-275432

(51) Int. Cl.
*H01R 13/58* (2006.01)

(52) U.S. Cl. ..... 174/135; 174/168

(58) Field of Classification Search ..... 174/84 R, 174/168, 135; 439/470, 471
See application file for complete search history.

(56) References Cited

U.S. PATENT DOCUMENTS

| | | | |
|---|---|---|---|
| 3,638,169 | A | 1/1972 | Caveney et al. |
| 4,444,450 | A | 4/1984 | Huber |
| 5,700,156 | A | 12/1997 | Bussard et al. |
| 6,762,363 | B2 | 7/2004 | Yamashita et al. |
| 2002/0170736 | A1 | 11/2002 | Yamashita et al. |

*Primary Examiner*—Chau N Nguyen
(74) *Attorney, Agent, or Firm*—Gerald E. Hespos; Michael J. Porco

(57) ABSTRACT

A wire fixing portion (17) is so formed with a slit (24) as to minimize a tightening diameter at the wire fixing portion (17) by narrowing the slit (24). Thus, there is no likelihood of displacing a fixing band (25) fastened to a middle part of the wire fixing portion (17) toward a side where the tightening diameter is larger. Accordingly, displacements of the fixing band (25) relative to the wire fixing portion (17) are restricted, wherefore displacements of the wires (W) relative to the wire fixing portion (17) are suppressed.

14 Claims, 13 Drawing Sheets

WIRE HOLDER

BACKGROUND OF THE INVENTION

1. Field of the Invention

The invention relates to a wire holder for leading and holding wires drawn out from a housing in a specified direction.

2. Description of the Related Art

U.S. Pat. No. 6,762,363 discloses a wire holder that is mounted to a housing for holding wires drawn out from the housing and leading the wires in a specified direction. The wire cover has a wire lead-out opening with an open rear end. The wires drawn out from the housing are bent in the wire cover and led out backward through the wire lead-out opening.

A wire fixing portion projects back at the wire lead-out opening and a binding band is wound with the wires placed along the wire fixing portion. The wires then are pressed to the wire fixing portion by tightening the binding band.

The tightly fastened binding band bites in insulation coatings of the wires and fixes firmly to the wires. However, the binding band is not secured firmly to the wire fixing portion. Thus, the binding band will slip on the wire fixing portion if the wires are subject to vibration and the wires can displace. Displacement of the wires can cause contact failures between terminals on the ends of the wires and mating terminals, fine sliding abrasion, and the like.

The invention was developed in view of the above and an object thereof is to suppress displacements of wires relative to a wire fixing portion.

SUMMARY OF THE INVENTION

The invention relates to a wire holder to be mounted on a housing. The wire holder holds one or more wires drawn out from the housing and leads the wires in a specified direction. The wire holder comprises a wire fixing portion that is long in a lead-out direction of the wires. A fixing member is arranged around the wire fixing portion and the wires for holding wires together with the wire fixing portion. The wire fixing portion is formed so that a tightening diameter of the fixing member is smallest at a longitudinal intermediate part of the wire fixing portion. Thus, the fixing band will not displace from the intermediate part towards the end where the tightening diameter is larger. Accordingly, displacements of the wires relative to the wire fixing portion are suppressed since the fixing band cannot displace along the wire fixing portion.

The wire fixing portion preferably is formed with at least one slit and the tightening diameter at the wire fixing portion decreases as the slit is narrowed. The decrease of the tightening diameter at the slit restricts displacements of the fixing band on the wire fixing portion and suppresses displacements of the wires relative to the wire fixing portion.

Opposite lateral edges of the wire fixing portion along the slit preferably are narrowed gradually from the opposite longitudinal ends towards the middle. Thus, the fixing band moves towards the intermediate part of the wire fixing portion as the fixing band is tightened. Therefore, displacements of the fixing band relative to the wire fixing portion are suppressed reliably.

At least one surface of the wire fixing portion not facing the wires preferably is curved concavely. Thus, the fixing band easily can be fastened close to the wire fixing portion. Therefore the wires can be tightened firmly even if dimensional tolerances of the wire fixing portion and the fixing band are large.

The wire fixing portion preferably is arranged at a side in a resilient restoring direction of the bent wires. Thus, the wires and the wire fixing portion can be fixed more firmly by resilient restoring forces of the wires.

The fixing member preferably is fixed to bite in insulation coatings of the wires.

The wire fixing portion preferably has one or more curved or recessed side surfaces to define a reduced width. The recesses preferably are on opposite side surfaces of the wire fixing portion and are substantially symmetrical with respect to width direction.

These and other objects, features and advantages of the invention will become more apparent upon reading the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A wire holder according to a first embodiment of the invention is identified by the numeral 10 in FIGS. 1 to 8. The wire holder 10 is mountable to a connector 30 connectable with a device-side connector (not shown) for leading wires W drawn out from the connector 30 and fixing them to a vehicle body.

Figure 1:
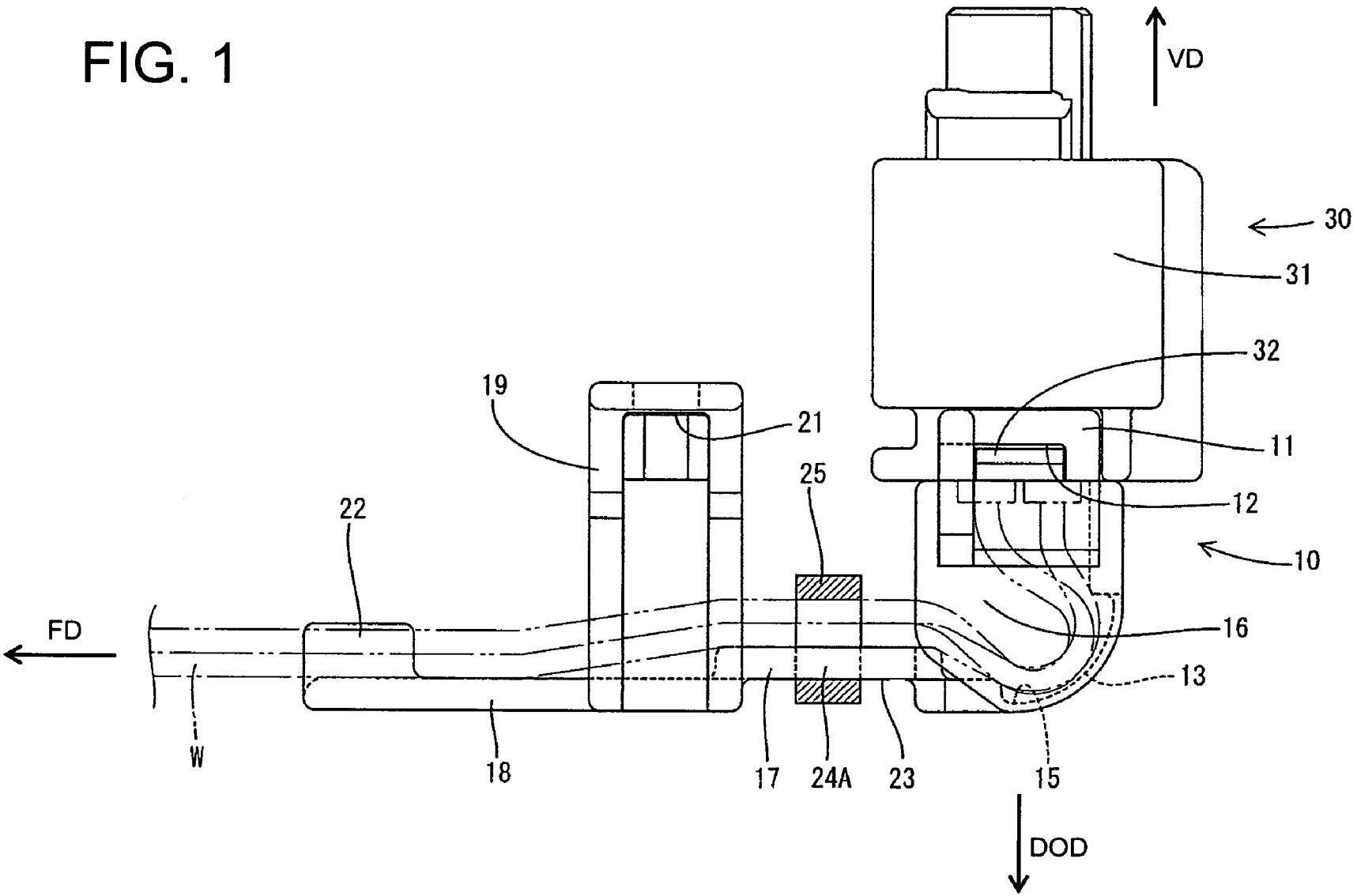
FIG. 1 is a side view showing a state where wires are bent by a wire holder according to a first embodiment.
Figure 2:
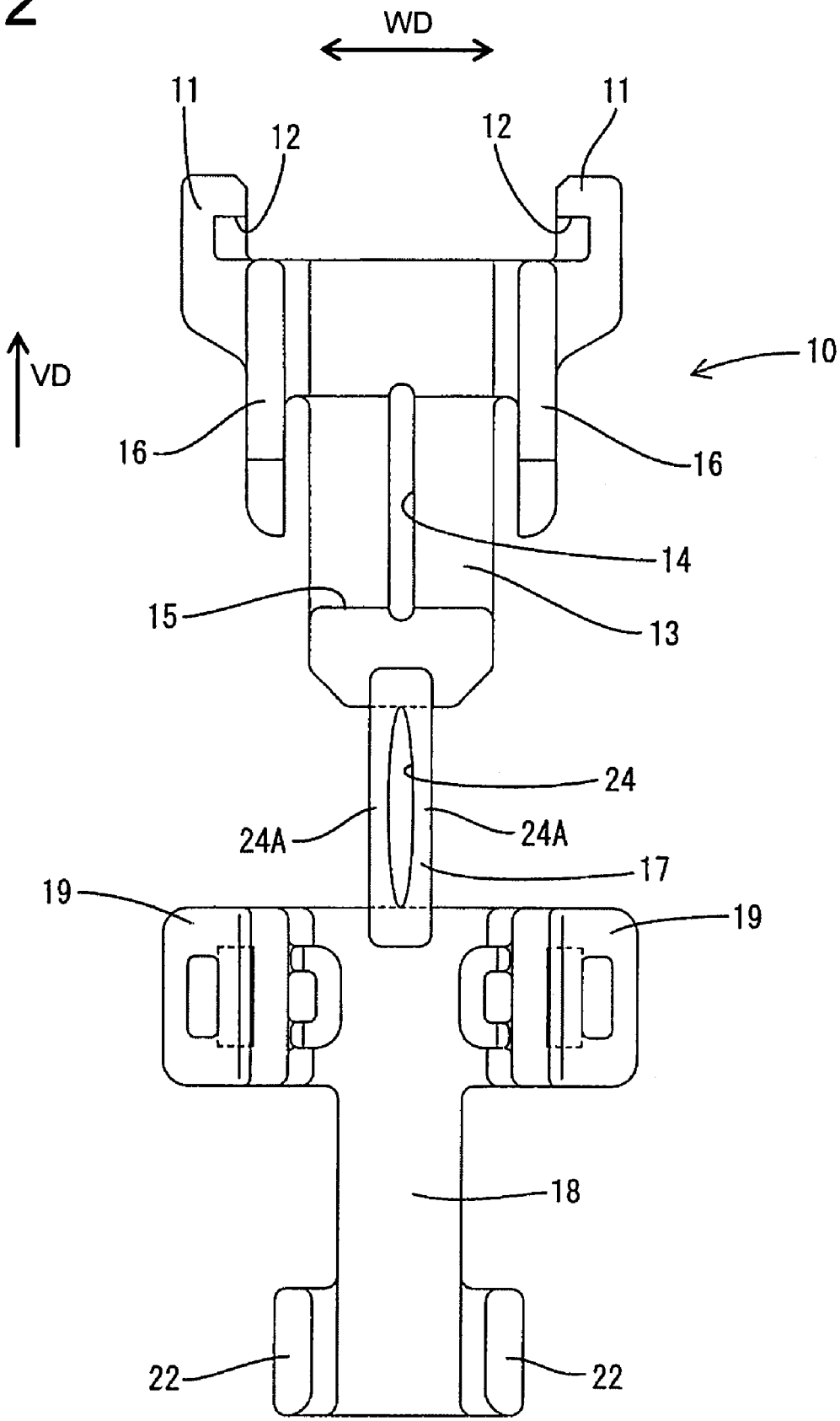
FIG. 2 is a front view of the wire holder.

To provide a frame of reference, the vertical orientation of FIG. 1 is referred to herein as the vertical direction VD and is parallel to a draw-out direction DOD of the wires W. A direction in which the wires W are bent is referred to as the forward direction FD is substantially normal to the vertical direction VD and the draw-out direction DOD of the wires W.

The connector 30 includes a housing 31 substantially in the form of a rectangular parallelepiped made e.g. of a synthetic resin and terminal fittings (not shown) are accommodated therein. The terminal fittings are inserted substantially vertically into the housing 31 and are arrayed in front and back rows. The wires W connected with the terminal fittings extend substantially down from the bottom surface of the housing 31 and are arrayed in each of front and back rows. Two locking projections 32 are provided near the bottom end of this housing 31 and are spaced apart in the width direction WD.

The wire holder 10 holds the wires W drawn out downward from the housing 31 and bends the wires W at a substantially right angle to extend substantially in the forward direction FD. The wire holder 10 is made e.g. of a synthetic resin and has a vertically long configuration before the wires W are bent. The wire holder 10 is mountable along the rear side of the six wires extending down from the housing 31.

As shown in FIGS. 1 to 4, two mounting portions 11 are spaced apart in width direction WD near the upper end of the wire holder 10 for holding the wire holder 10 on the housing 31. Each mounting portion 11 is formed with a substantially rectangular locking hole 12 that is longer in forward and backward directions. The locking projections 32 can be fit into the respective locking holes 12 for mounting the wire holder 10 on the housing 31.

A wire bending portion 13 is provided below from the mounting portions 11 and is bendable in forward and backward directions. The wire bending portion 13 is a thin rectangular plate that is longer in the vertical direction VD and has a smaller thickness in forward and backward directions as compared to parts above and below the wire bending portion 13. An oblong hole 14 is formed in the wire bending portion 13 and is long substantially in vertical direction VD at a widthwise middle position so as to have higher flexibility than the other parts. The wire bending portion 13 can be bent at a right angle to extend substantially forward, and the wires W arranged before the wire bending portion 13 are bent at a substantially right angle.

Figure 3:
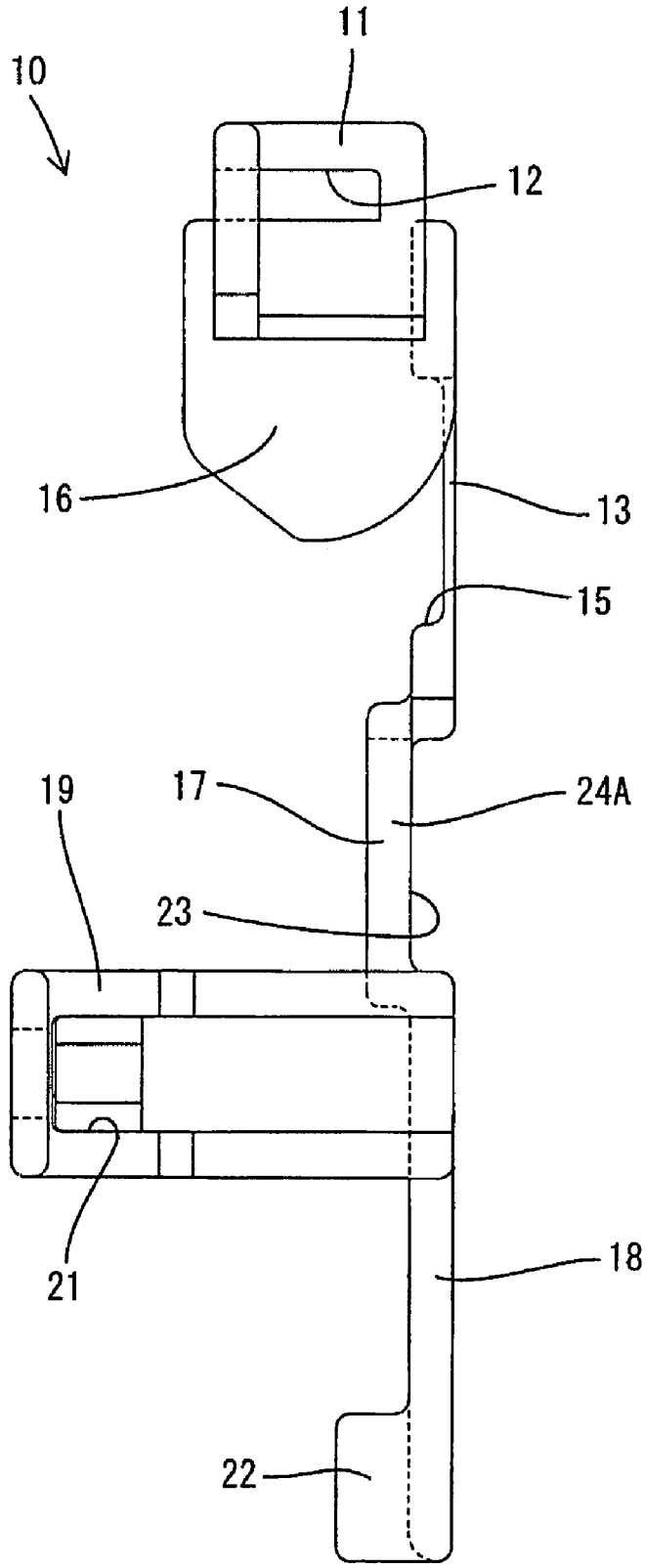
FIG. 3 is a side view of the wire holder.
Figure 4:
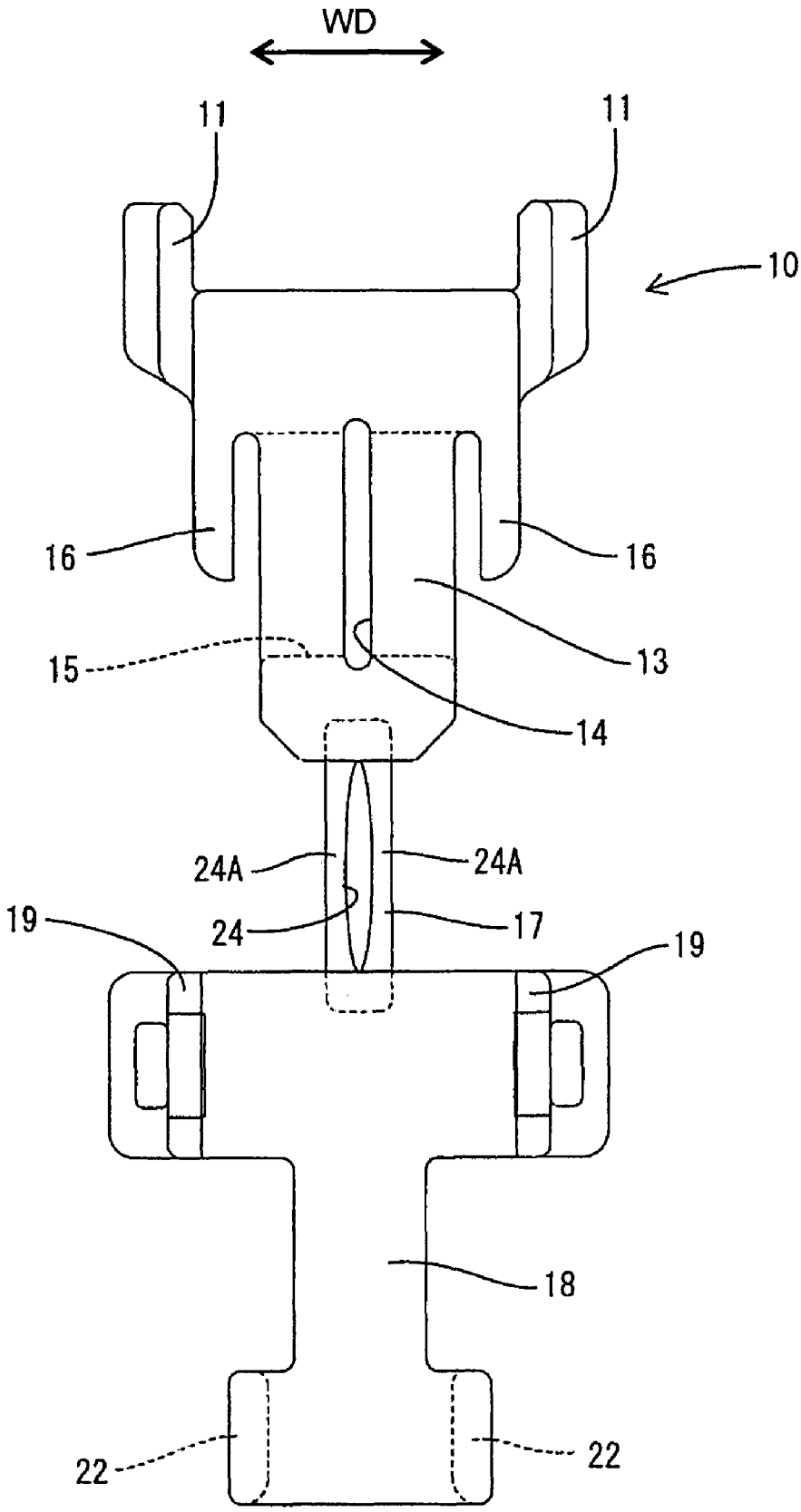
FIG. 4 is a rear view of the wire holder.
Figure 5:
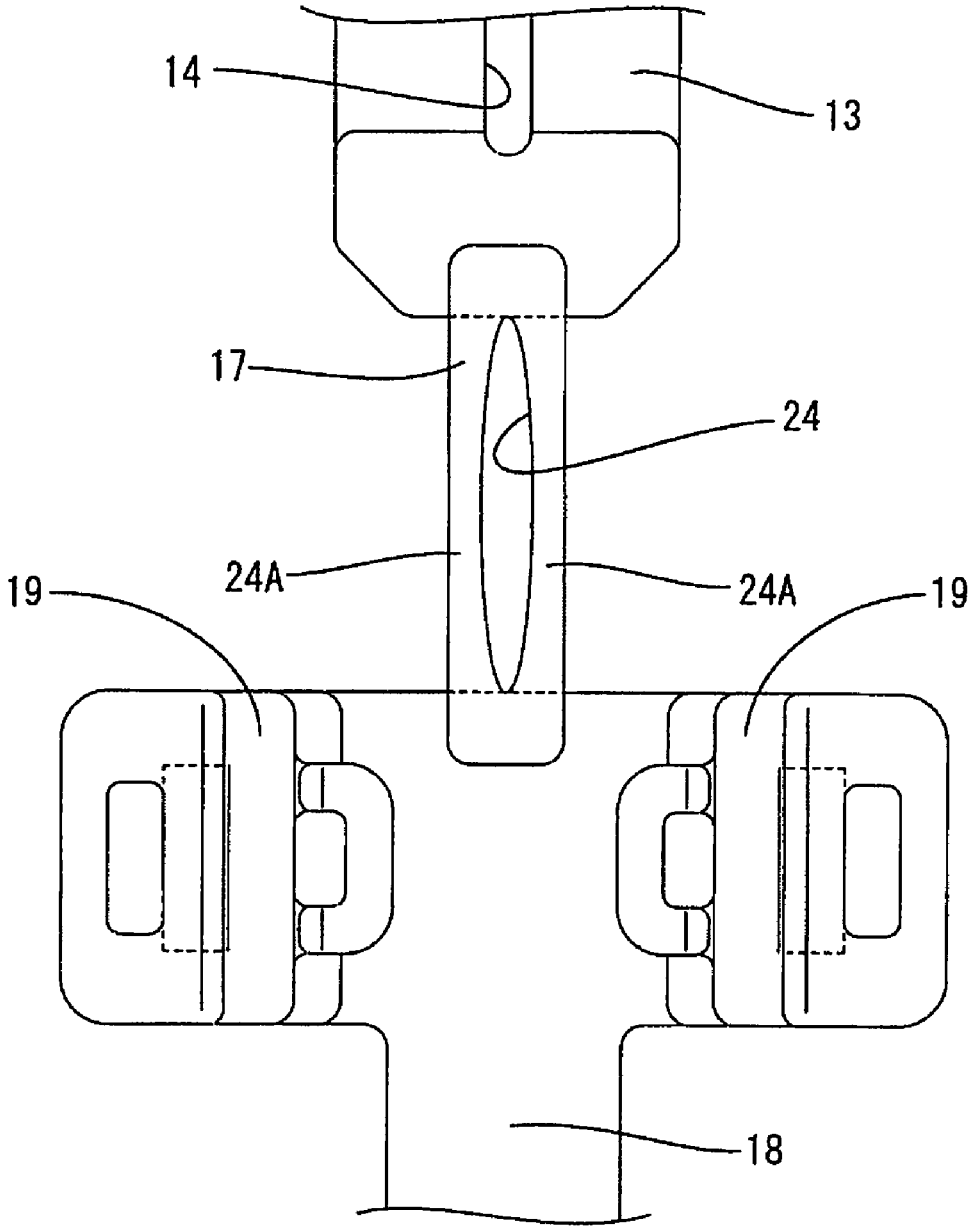
FIG. 5 is a partial front view of the wire holder.
Figure 6:
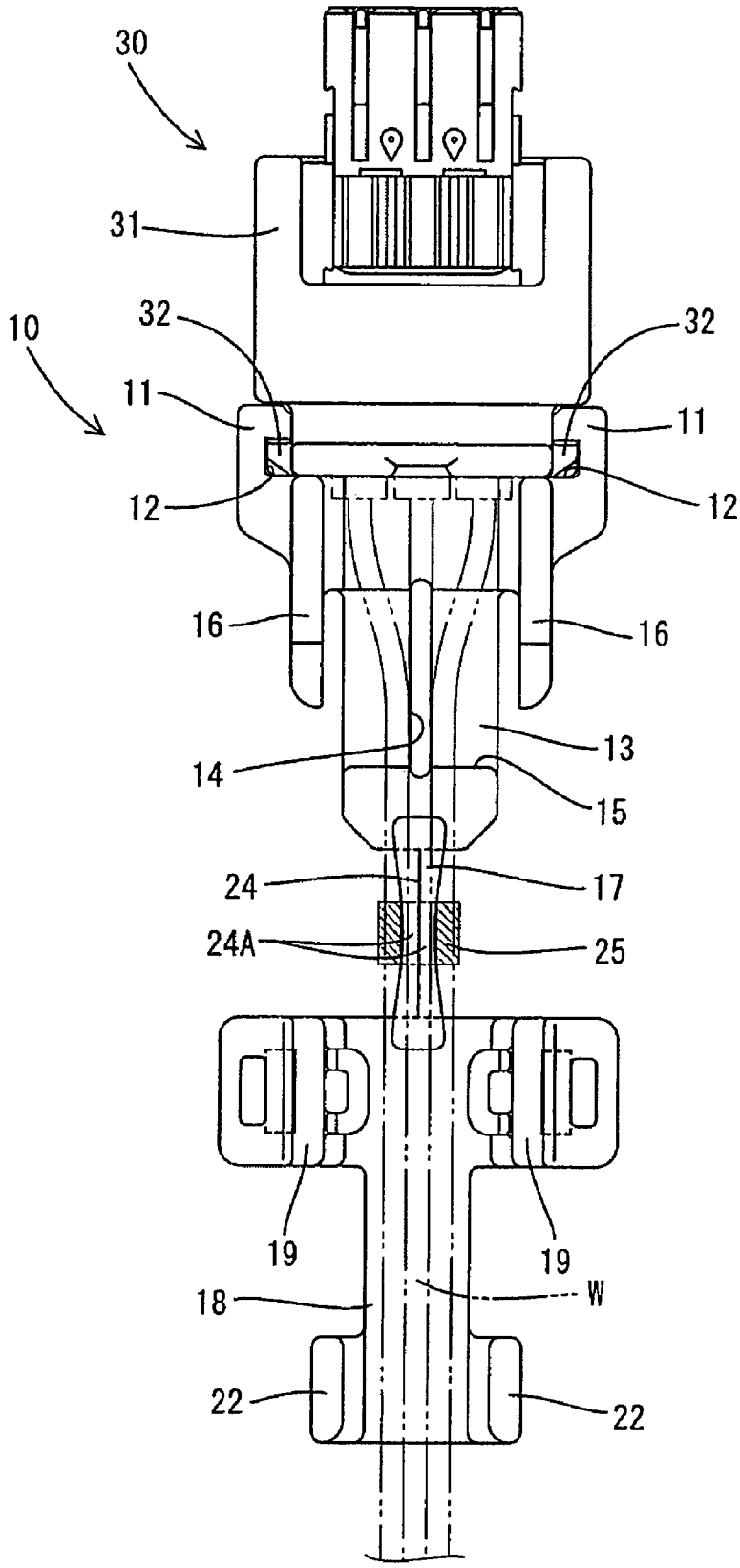
FIG. 6 is a front view showing a state where the wire holder is mounted on a connector.
Figure 7:
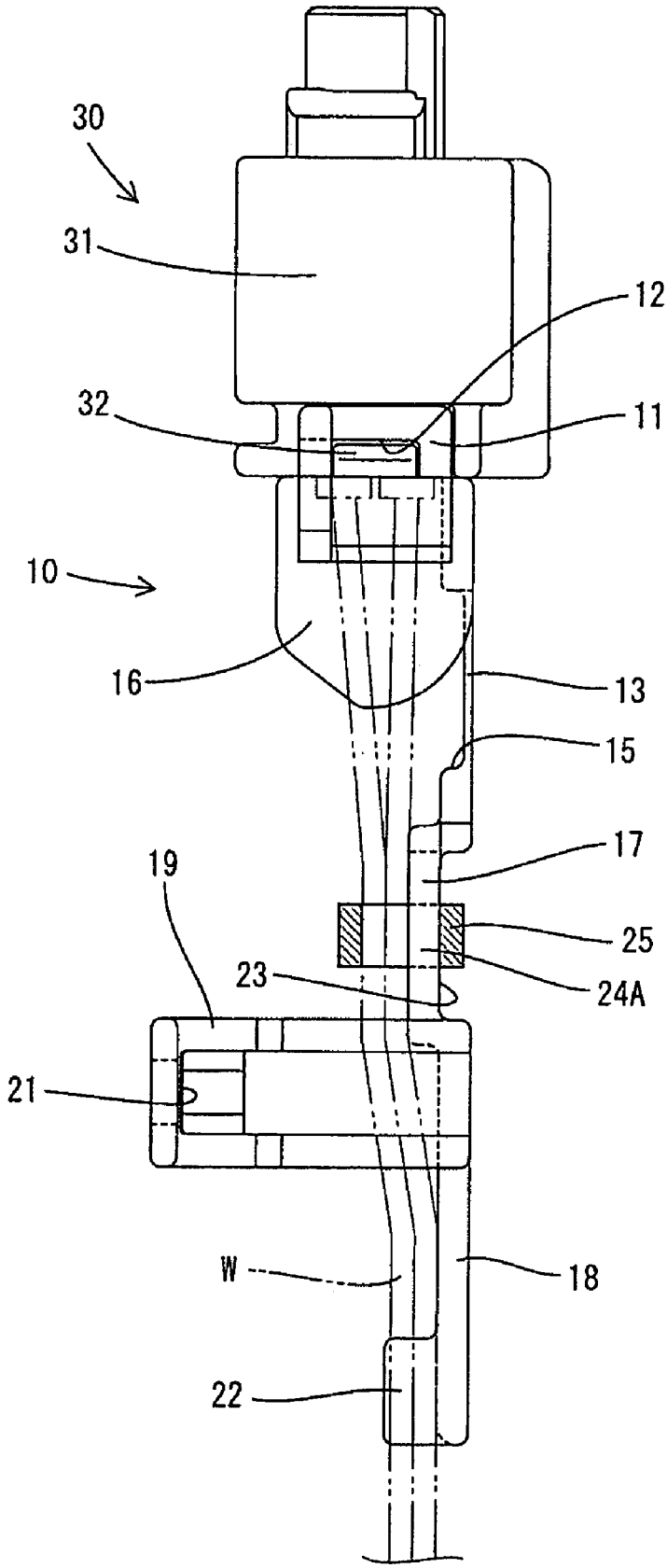
FIG. 7 is a side view showing a state where the wire holder is mounted on the connector.

This wire bending portion 13 is more backward than the other parts of the wire holder 10, and a wire escaping recess 15 is formed in the front side of the wire bending portion 13 (see FIGS. 1 and 3).

Two protection walls 16 are provided at the opposite sides of the wire bending portion 13. The protection walls 16 have inner surfaces facing each other, and the rear edges of the bottom ends thereof are rounded to conform substantially to the wire bending portion 13 in its bent state. The protection walls 16 substantially completely cover the opposite sides of the entire bent parts of the wires W located inside to protect the bent parts.

A wire fixing portion 17 is below the wire bending portion 13 and defines the part of the wire holder 10 to which the wires W are to be fastened.

A wire guide 18 is at the bottom end of the wire holder 10 and holds the wires W bent substantially at right angles to extend substantially forward. The wire guide 18 is a flat plate long in the extending direction of the wires W.

Two vehicle body fixing portions 19 are spaced apart in the width direction WD near the upper end of the wire guide 18 and are configured to be mounted and fixed to a vehicle body. The vehicle body fixing portions 19 extend forward in the bent direction of the wires W from the opposite lateral edges of the wire guide 18. The vehicle body fixing portions 19 are formed with fixing holes 21 engageable with fixing projections 20 on the vehicle body.

Two guiding walls 22 are spaced apart in the width direction WD near the bottom end of the wire guide 18. The guiding walls 22 extend forward from the opposite lateral edges of the wire guide 18, and the height thereof is larger than the height of the wires 2, more preferably slightly larger than twice the height of the wires 2.

The wire fixing portion 17 between the wire bending portion 13 and the wire guide 18 has a vertically long shape along the draw-out direction DOD of the wires W. Additionally, the wire fixing portion 17 is substantially rectangular shape, and has a substantially constant width at all locations along the vertical direction VD. It should be noted that the wire fixing portion 17 is narrower than both the wire bending portion 13 and the wire guide 18.

The wire fixing portion 17 is arranged at a position displaced forward (toward the side where the wires W are arranged) from the wire bending portion 13 and the wire guide 18, and is formed with a recess 23 retracted from the rear surfaces of the wire bending portion 13 and the wire guide 18 by the thickness of the wire guide 18.

The thickness of the wire fixing portion 17 in forward and backward directions is substantially equal to that of the wire guide 18, and the wire guide 18 projects more forward (toward the side where the wires W are arranged) than the bending portion 13 by the thickness of the wire guide 18.

A vertically long slit 24 is formed substantially at a widthwise middle position of the wire fixing portion 17 and penetrates the wire fixing portion 17 in forward and backward directions. The slit 24 is shaped to become gradually wider from the opposite longitudinal ends thereof towards a middle part. The longitudinal middle position of the slit 24 is substantially the same position as that of the wire fixing portion 17.

Both lateral edges 24A of the wire fixing portion 17 along the slit 24 are narrowed little by little toward the intermediate parts from the opposite longitudinal ends thereof. A longitudinal intermediate part of the wire fixing portion 17 has a smallest dimension when the slit 24 is closed so that the opposite lateral edges 24A of the slit 24 are held in close contact.

A fixing band 25 can tighten and fix the wires W by being wound around both the wire fixing portion 17 and the wires W with the wires W placed along the wire fixing portion 17. The fixing band 25 is made of a relatively flexible synthetic resin, such as polyethylene, to have sufficient flexibility to be bendable by hand and fingers.

The wire holder 10 initially is mounted on the connector 30 that has been connected with the device-side connector. More particularly, the wire holder 10 is placed along the rear side of the wires W extending substantially straight down from the housing 31 in the draw-out direction DOD so that the locking holes 12 of the wire holder 10 engage the locking projections 32 of the housing 31. As a result, the wires W in the back row extend substantially along the front surface of the wire fixing portion 17 (see FIG. 7).

The fixing band 25 then is used to fasten the wires W to the wire fixing portion 17. In particular, the wires W are bundled to bring the wires W closer in the width direction WD and to bring the wires W in different rows closer to each other (e.g. the front row closer to the back row). Additionally, the wires W are caused positioned along the front surface of the wire fixing portion 17. The fixing band 25 then is wound around both the wires W and the wire fixing portion 17. The fixing band 25 surrounds the bundle of the wires W and the wire fixing portion 17 over the entire circumference substantially in conformity with the outer shapes of the wire bundle and the wire fixing portion 17. The fixing band 25 is tightened so that the diameter of the winding part is reduced to tighten the outer circumferences of the bundle of the wires W and the wire fixing portion 17. At this time, a rear part of the fixing band 25 is accommodated in the recess 23 on the rear side of the wire fixing portion 17 and, hence, does not project back from the wire holder 10.

The wire fixing portion 17 deforms as the fixing band 25 is tightened and the opposite lateral edges 24A of the slit 24 come closer together. The narrowing of the slit 24 and the narrowing of the entire wire fixing portion 17 is gradual from opposite ends of the wire fixing portion 17 towards the intermediate parts thereof (see FIG. 6). The fixing band 25 initially may be wound at a position slightly displaced forward or back from the longitudinal middle of the wire fixing portion 17. However, the fixing band 25 gradually moves towards the longitudinal middle during tightening and, finally, is arranged substantially at the longitudinal center of the wire fixing portion 17 where the tightening diameter is smallest.

Opposite side surfaces of the wire fixing portion 17 arch moderately towards the longitudinal middle when the slit 24 closes, so that the fixing band 25 extends along the side surfaces of the wire fixing portion 17 with virtually no clearance.

A wire fixing portion could be designed to bulge out in the width direction WD farther than the bundle of the wires W. In this situation, clearances would exist at lateral sides of the wires W even if the fixing band is tightened strongly, and a strong force on the wires W would cause the wires W to displace towards the clearances. However, the longitudinal middle of the wire fixing portion 17 is narrowed sufficiently when the slit 24 is closed so that the wire fixing portion 17 does not bulge out in the width direction WD beyond the cross-sectional dimension of the bundle of wires W. Thus, there are hardly any clearances at the lateral sides of the wires W and the wire fixing portion 17 prevent s the wires W from displacing in the width direction WD.

The front surface of the wire fixing portion 17 is substantially flat when the slit 24 is closed, and the wires W are held in close contact with this front surface.

In this way, the fixing band 25 is wound, bent or folded to tighten the wires W and the wire fixing portion 17 together. Additionally, the fixing band 25 is fixed to bite in or engage the insulation coatings of the wires W. The tightening of the fixing band 25 keeps the wires W pressed firmly against the wire fixing portion 17.

The wires W are fixed to the wire fixing portion 17 before the wires W are bent. Thus, resilient restoring forces of the wires W do not act on the wire fixing portion 17 while the wires W are being fixed. Accordingly, the fixing operation can be performed easily as compared to the case where the bent wires W are fixed to the wire fixing portion 17.

The wire bending portion 13 of the wire holder 10 is bent forward to bend the wires W in the forward direction FD. Here, the wires W try to slide forward relative to the wire holder 10 as the wire bending portion 13 is bent. The fixing band 25 is fixed to bite in or engage the wires W and tries to slide forward with the wires W and towards the wire guide 18. However, the fixing band 25 is fastened at the intermediate position where the width of the wire fixing portion 17 is smallest and cannot displace to wider parts of relative to the wire fixing portion 17. Accordingly, the fixing band 25 will not displace relative to the wire fixing portion 17 and forward displacement of the wires W is prevented. Sections of the wires W above the wire fixing portion 17 are bent while being gradually separated from each other. The bent parts of the wires W fit into the wire escaping portion 15 on the front side of the wire bending portion 13, as shown in FIG. 1, and are caught by the upper and lower steps of the wire escaping portion 15. Forces to displace the bent wires W forward or backward in the longitudinal direction of the wires W are received by these engagements. This engagement of the wires W with the steps and the wire escaping portion 15 contributes to the retention of the wire fixing portion 17 to prevent displacement of the wires W in forward and backward directions.

The wire fixing portion 17 is adjacent to and right below the wire bending portion 13, and hence is at a position to receive most of the resilient restoring forces of the wires W when the wires W are bent. The wires W are fixed to the wire holder 10 at this position. Thus, the wire holder 10 cannot separate from the wires W. Additionally, the wires W and the wire holder 10 can be bent in unison at the wire bending portion 13.

The wire fixing portion 17 projects towards the side where the wires W are arranged. The wires W are placed on the wire fixing portion 17 and are fixed while being caught by corners at the upper and bottom ends. Forward and backward displacements of the wires W are restricted by these engagements in addition to the tightening force of the fixing band 25.

Figure 8:
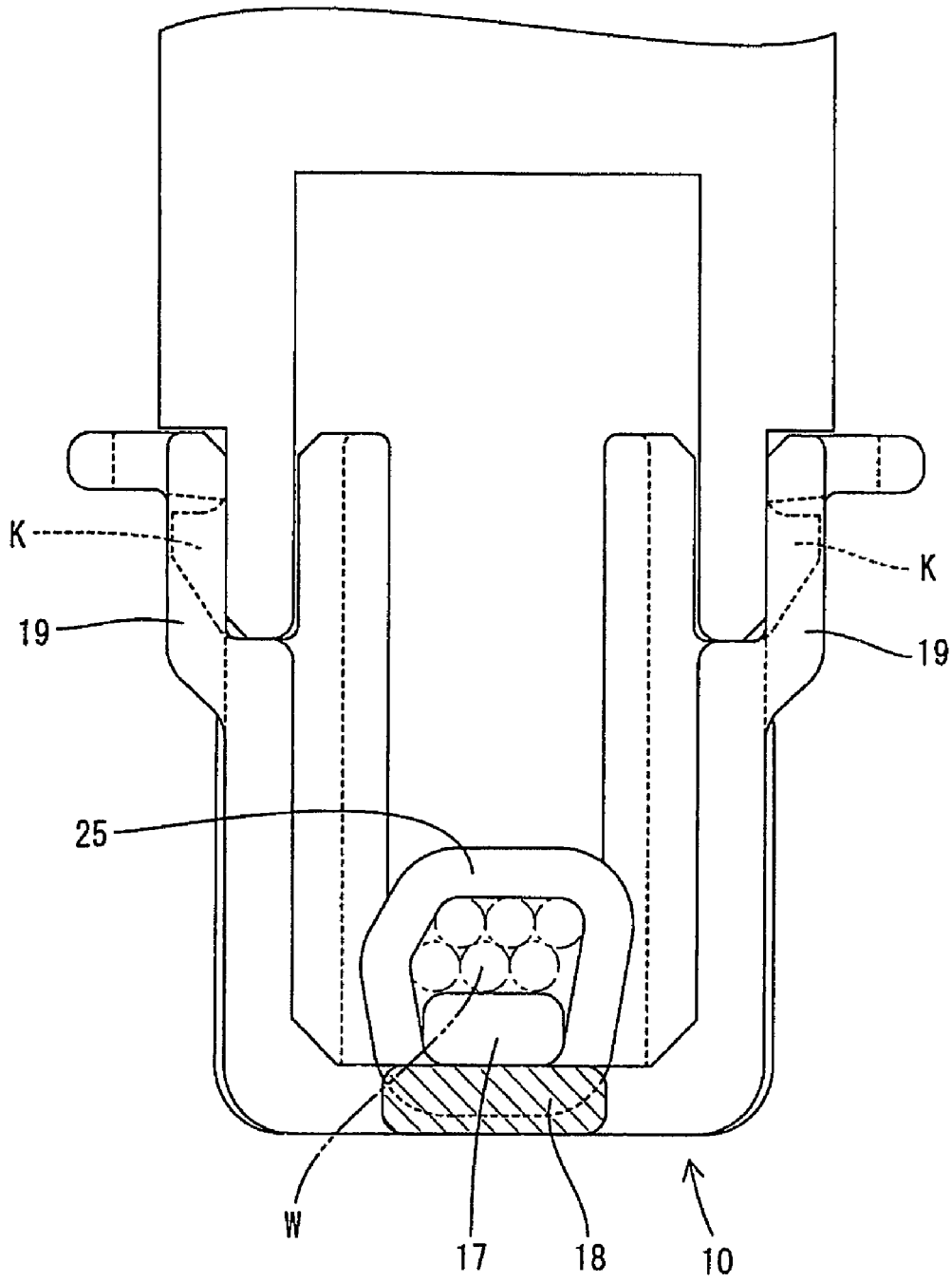
FIG. 8 is a front view in section showing a state where the wire holder is fixed to a vehicle body.

With the wires W bent substantially at right angles, the vehicle body fixing portions 19 are fixed to fixing projections K of the vehicle body (see FIG. 8). The wire guide 18 then is held while extending forward and horizontally. Thus, the wire guide 18 supports the wires W from below and prevents the bent parts of the wires from being resiliently restored in a direction to increase the bending angles.

In this way, the wire holder 10 is held so that the wire bending portion 13 is bent and the wire guide 18 extends forward. The wires W are held bent substantially at a right angle to extend forward after extending down in the draw-out direction DOD from the housing 31.

The wires W may vibrate as the vehicle body vibrates. However, the wire fixing portion 17 reliably prevents displacements of the wires W. Accordingly, even if the wires W repeatedly vibrate, there is no likelihood of transmitting this vibration to the ends of the wires W and causing contact failures, fine sliding abrasion and other problems between the terminals secured to the ends of the wires W and the mating terminals. It should be noted that large displacements of the wires W in the width direction WD also are restricted by the pair of mounting portions 11 and the pair of guiding walls 22.

As described above, the slit 24 enables the wire fixing portion 17 to have a minimum tightened width at a middle position. The fixing band 25 is fastened at the narrow part of the wire fixing portion 17 and cannot displace towards the wider ends. This fixed disposition of the fixing band 25 restricts displacements of the wires W relative to the wire fixing portion 17.

The opposite lateral edges 24A of the wire fixing portion 17 along the slit 24 are so shaped to narrow gradually from the opposite longitudinal ends towards the middle. Thus, the fixing band 25 displaces towards the middle part of the wire fixing portion 17 during tightening due to the narrowing of the slit 14. Therefore, displacements of the fixing band 25 relative to the wire fixing portion 17 are suppressed reliably.

The wire fixing portion 17 is arranged at the side towards which the bent wires W resiliently restore. Thus, the wires W and the wire fixing portion 17 are fixed more firmly by the resilient restoring forces of the wire W.

A wire holder 50 according to a second embodiment of the invention is identified generally by the numeral 50 in FIGS. 9 to 13. The wire holder 50 differs from the first embodiment in that a wire fixing portion 51 is shaped so that a tightening diameter of a fixing band 25 is smallest at a longitudinal intermediate part instead of forming the slit 24. It should be noted that elements with the same construction or similar construction as the first embodiment are not described again but identified by the same reference numerals.

Figure 9:
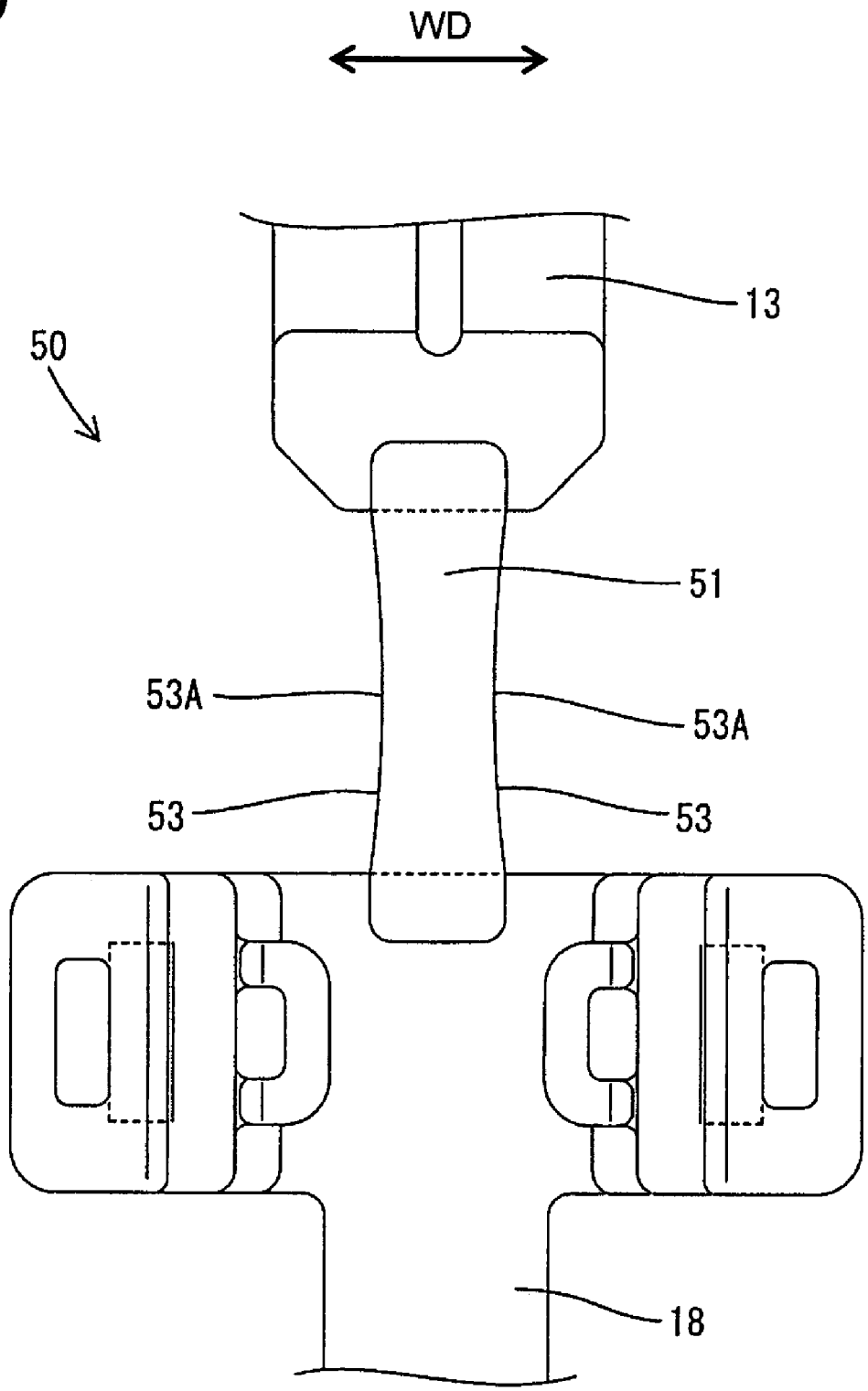
FIG. 9 is a partial front view of a wire holder according to a second embodiment.
Figure 10:
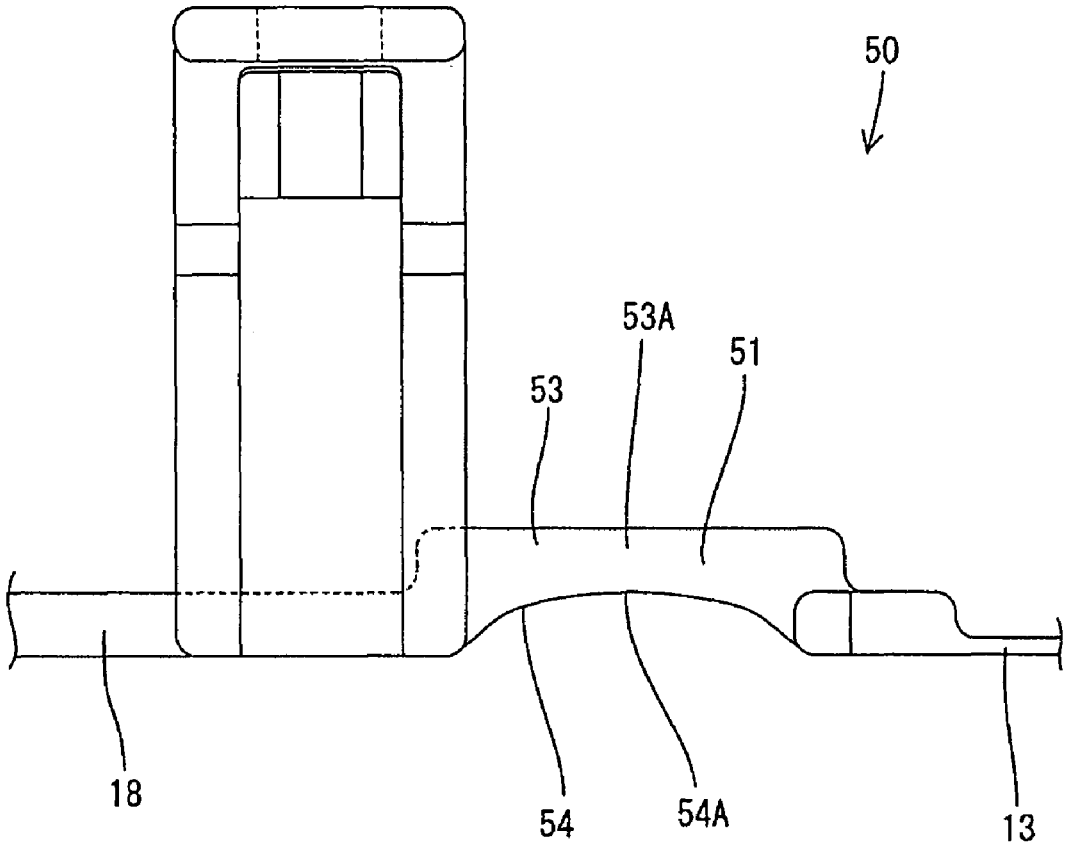
FIG. 10 is a partial side view of the wire holder.

As shown in FIGS. 9 and 10, the wire fixing portion 51 has concave side surfaces 53 and rear surface 54 that faces away from the wires W.

A recess 54A is formed on the rear surface 54 of the wire fixing wire fixing portion 51 towards an intermediate position thereof. The maximum depth of the recess 54A from the rear surface of a wire guide 18 and a wire bending portion 13 substantially equals the thickness of the wire guide 18. A longitudinal middle where the recess 54A is deepest is approximately flat.

Recesses 53A also are formed at the opposite side surfaces 53 of the wire fixing portion 51 and are substantially symmetrical with respect to the width direction WD. The recesses 53A are arched moderately from the opposite longitudinal ends of the wire fixing portion 51 towards the middle similar to the recess 54A of the rear surface 54. The recessed dimension of these opposite side surfaces 53 is smaller than that of the rear surface 54. The recesses 53A of the opposite side surfaces 53 are arched moderately along the entire longitudinal direction substantially as much as the longitudinal middle part of the recess 54A of the rear surface 54.

The longitudinal intermediate part of the wire fixing portion 51 is narrowest by forming the rear surface 54 and the opposite side surfaces 53 of the wire fixing portion 51 to have concave shapes shown in FIGS. 9 and 10.

Figure 11:
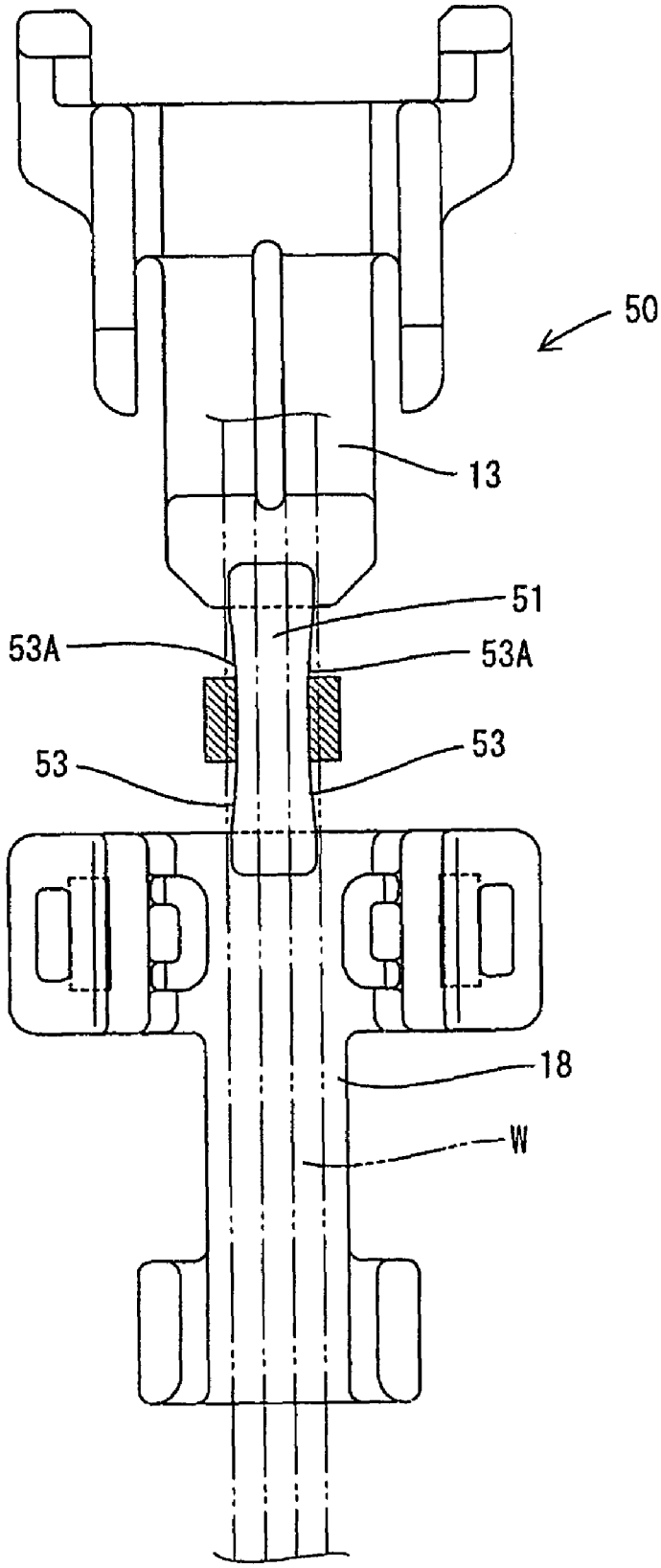
FIG. 11 is a front view showing a state where wires are fixed to the wire holder.
Figure 12:
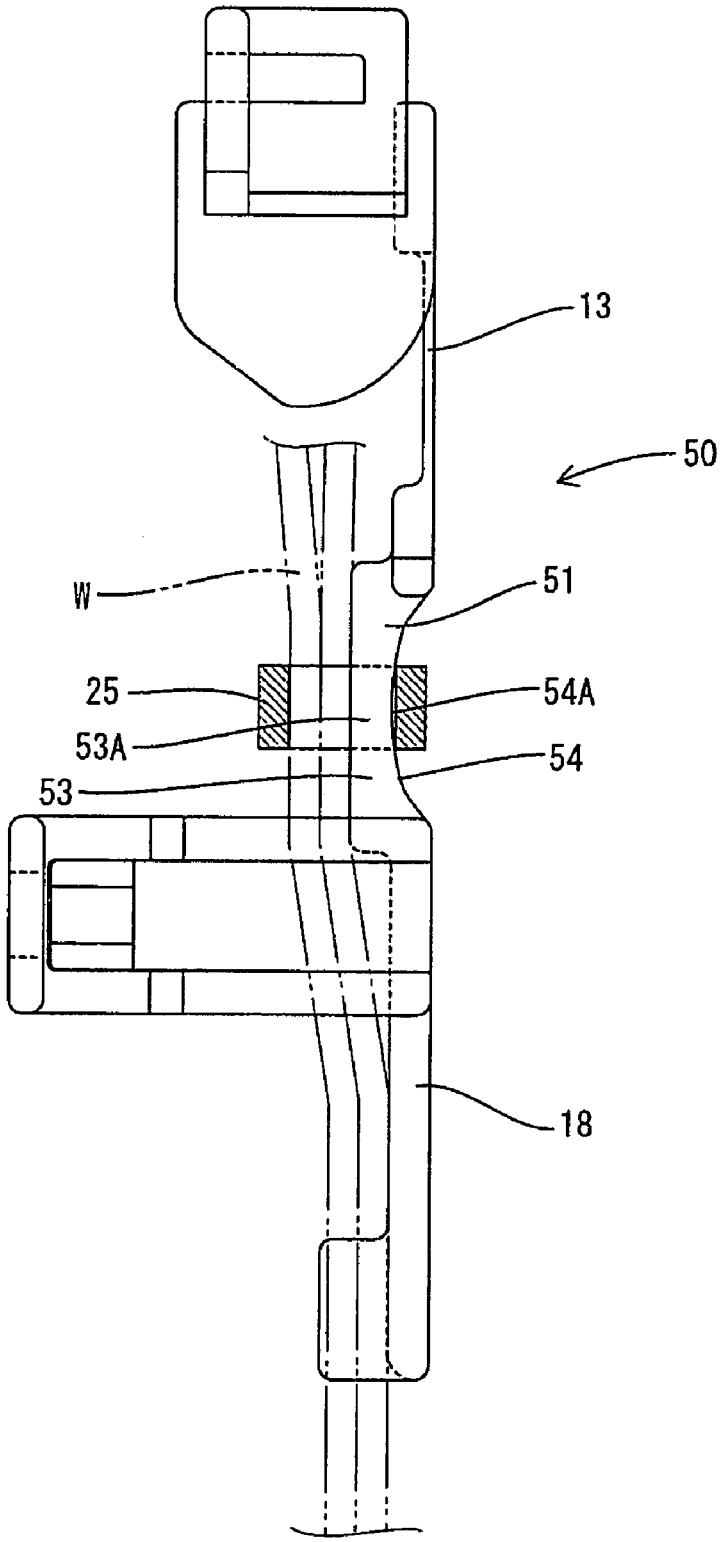
FIG. 12 is a side view showing the state where the wires are fixed to the wire holder.
Figure 13:
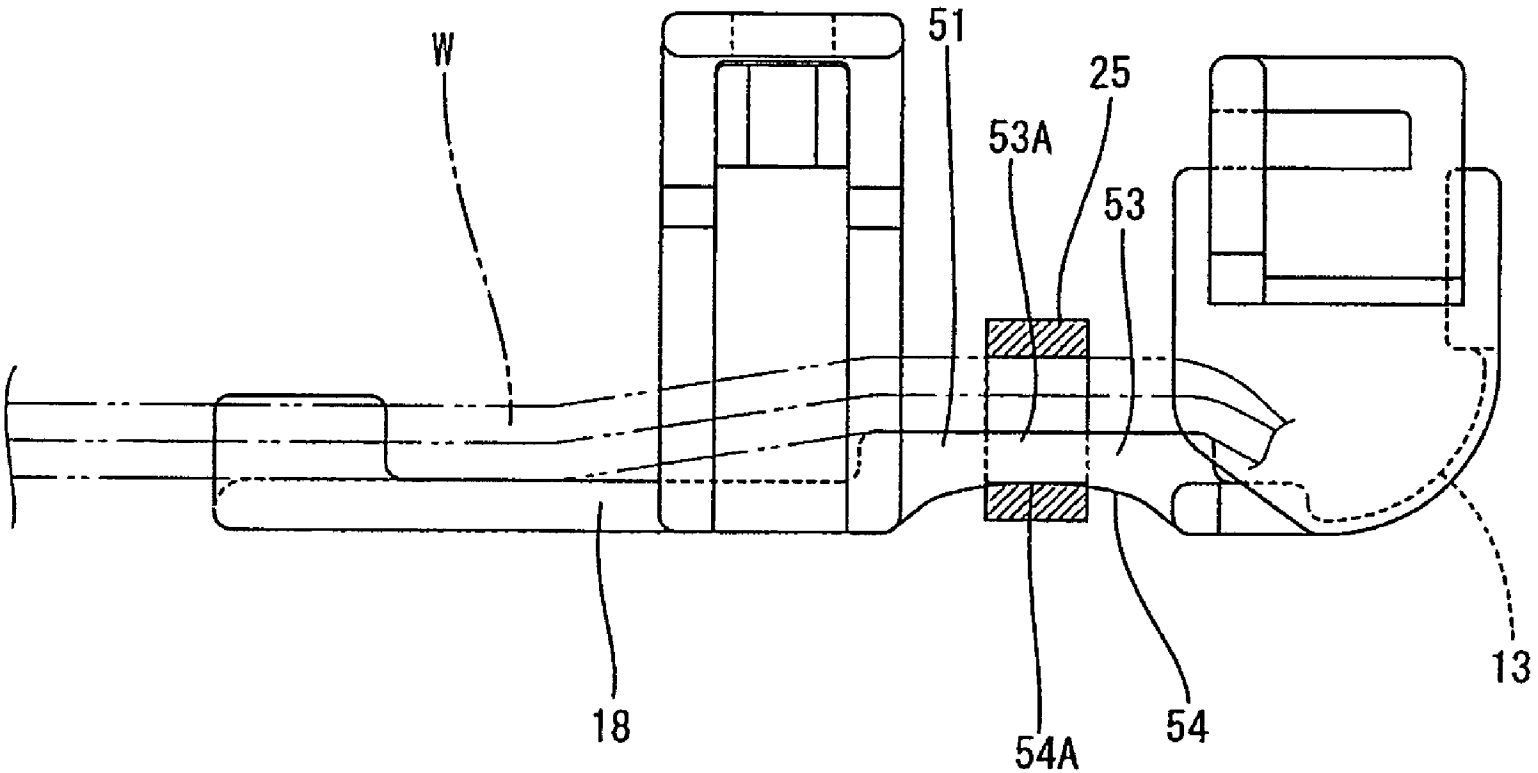
FIG. 13 is a side view showing a state where the wires are bent by the wire holder.

The wires W are held at the longitudinal middle of the wire fixing portion 51 by winding and tightening the fixing band 25 at the longitudinal middle position so that the wire fixing portion 51 bites in or strongly engages the outer surfaces of the wires W (see FIGS. 11 and 12).

As described above, the wire fixing portion 51 is narrowest at the longitudinal middle in this embodiment. Thus, the tightened fixing band 25 cannot displace from this middle part towards the ends where the wire fixing portion is wider, similar to the first embodiment. Therefore, displacements of the wires W relative to the wire fixing portion 51 are suppressed.

The recesses 53A of the opposite side surfaces 53 of the wire fixing portion 51 and the recess 54A of the rear surface 54 are moderate concave curves. If a dimension of a wire fixing portion was decreased, for example, by forming the recesses to conform closely to the shape of the fixing band 25, the fixing band 25 might not fit properly into the recess and displacements of the fixing band 25 relative to the wire fixing portion might not be restricted. However, the moderately curved recesses 53A, 54A in this embodiment enable the fixing band 25 to be fastened more closely regardless of the width of the fixing band 25. Therefore the fixing band 25 can be fastened firmly while avoiding the above situation and displacements of the wires W is reliably restricted.

The invention is not limited to the above described and illustrated embodiments. For example, the following embodiments are also embraced by the technical scope of the present invention as defined by the claims.

The slit 24 in the wire fixing portion 17 extends substantially in forward and backward directions in the first embodiment. However, the invention is not limited thereto and the slit 24 may extend in width direction WD or any other direction.

The wire fixing portion 17 has a substantially rectangular outer shape with a substantially constant width in vertical direction VD and the tightening diameter at the wire fixing portion 17 decreases as the slit 24 is narrowed in the first embodiment. However, the invention is not limited thereto and a slit may be formed in a wire fixing portion having a different outer shape to have a smallest tightening diameter at its middle part.

The rear surface 54 and opposite side surfaces 53 of the wire fixing portion 51 are recessed in the second embodiment. However, only the rear surface or only one of the side surfaces may be recessed.

Although the rear surface 54 and the opposite side surfaces 53 of the wire fixing portion 51 are concave curves in the second embodiment, the invention is not limited thereto and any shapes may be adopted provided that the tightening diameter of the fixing band is smallest at the intermediate part of the wire fixing portion.

Although the invention is applied to the wire holder 10 (50) for leading and holding the wires W drawn out from the housing in the specified direction in the above embodiments, the invention is not limited thereto and may be applied to a wire cover for protecting ends of wires drawn out from a housing by surrounding the wires.

The wire fixing portion 17 (51) is located in the resilient restoring direction of the bent wires W in the foregoing embodiments, but it may not necessarily be located at the side in the resilient restoring direction.

Although displacements of the fixing band 25 are restricted by making the tightening diameter of the fixing band 25 smallest at the intermediate position of the wire fixing portion 17 (51) in the foregoing embodiments, it may be made additionally difficult for the fixing band to displace relative to the wire fixing portion by embossing (preferably accordion-shaping) the outer surface of the wire fixing portion to improve a frictional force between the fixing band and the wire fixing portion.

What is claimed is:

1. A wire holder to be mounted to a housing to lead and hold at least one wire drawn out from the housing in a specified direction, comprising:

a mounting portion with a first end configured for mounting the wire holder on the housing and a second end opposite the first end;

a wire bending portion having a first end adjacent to the second end of the mounting portion, a second end opposite the first end and, a plate extending between the first and second ends, the plate being sufficiently thin and flexible to be bendable at a right angle;

at least one wire fixing portion adjacent to the second end of the wire bending portion, the wire fixing portion having a shape long in a lead-out direction of the at least one wire and being movable with the second end of the wire bending portion from the specified direction; and at least one fixing member configured for tightening the wire fixing portion and the at least one wire together by being arranged therearound with the at least one wire placed substantially along the wire fixing portion, wherein the wire fixing portion is formed such that a tightening diameter of the fixing member is smallest at a longitudinal intermediate part of the wire fixing portion.

2. The wire holder of claim 1, wherein at least one surface of the wire fixing portion not facing the at least one wire is curved concavely.

3. The wire holder of claim 1, wherein the fixing member is configured to bite into insulation of the at least wire.

4. The wire holder of claim 1, wherein the wire fixing portion has at least one recessed side surface having a reduced width.

5. The wire holder of claim 4, wherein the recessed portions of the substantially opposite side surfaces of the wire fixing portion are substantially symmetrically shaped with respect to width direction.

6. The wire holder of claim 1, further comprising first and second substantially parallel protection walls extending from the mounting portion and provided at opposite sides of the wire bending portion, so that a space is defined by the wire bending portion and the two protection walls for receiving and protecting a wire drawn out of the housing.

7. The wire holder of claim 6, wherein a portion of the at least one wire substantially adjacent to the wire bending portion is bent at a substantially right angle in the space defined between the two protection walls.

8. The wire holder of claim 6, wherein the first and second protection walls have edges shaped to conform to the wire bending portion when the wire bending portion is in a bent state.

9. The wire holder of claim 6, wherein the first and second protection walls substantially cover opposite sides of bent parts of the wires.

10. A wire holder to be mounted to a housing to lead and hold at least one wire drawn out from the housing in a specified direction, comprising:

at least one wire fixing portion having a shape long in a lead-out direction of the at least one wire and being bendable from the specified direction; and at least one fixing member configured for tightening the wire fixing portion and the at least one wire together by being arranged therearound with the at least one wire placed substantially along the wire fixing portion, wherein the wire fixing portion is formed such that a tightening diameter of the fixing member is smallest at a longitudinal intermediate part of the wire fixing portion, wherein the wire fixing portion is formed with at least one slit and the tightening diameter at the wire fixing portion decreases the at least one slit is narrowed.

11. The wire holder of claim 10, wherein opposite lateral edges of the wire fixing portion along the slit are shaped to narrow gradually from opposite longitudinal ends toward an intermediate part.

12. A wire holder to be mounted to a housing to lead and hold at least one wire drawn out from the housing in a specified direction, comprising:

at least one wire fixing portion having a shape long in a lead-out direction of the at least one wire and being bendable from the specified direction; and at least one fixing member configured for tightening the wire fixing portion and the at least one wire together by being arranged therearound with the at least one wire placed substantially along the wire fixing portion, wherein the wire fixing portion is formed such that a tightening diameter of the fixing member is smallest at a longitudinal intermediate part of the wire fixing portion, wherein the wire fixing portion is disposed at a side in a resilient restoring direction of the at least one wire bent in the specified direction.

13. The wire holder of claim 12, wherein the wire fixing portion has at least one recessed side surface having a reduced width.

14. The wire holder of claim 13, wherein the recessed portions of the substantially opposite side surfaces of the wire fixing portion are substantially symmetrically shaped with respect to width direction.

* * * * *